US006036839A

United States Patent [19]

Kohut et al.

[11] Patent Number: 6,036,839

[45] Date of Patent: Mar. 14, 2000

[54] LOW DENSITY HIGH SURFACE AREA COPPER POWDER AND ELECTRODEPOSITION PROCESS FOR MAKING SAME

[75] Inventors: Stephen J. Kohut, Chandler, Ariz.; Ronald K. Haines, Mentor, Ohio; Nicholas D. Sopchak, Wynantskill, N.Y.; Wendy Gort, Tucson, Ariz.

[73] Assignee: ElectroCopper Products Limited, Mesa, Ariz.

[21] Appl. No.: 09/018,269

[22] Filed: Feb. 4, 1998

[51] Int. Cl.[7] ..... C25C 1/12

[52] U.S. Cl. ..... 205/574; 205/280

[58] Field of Search ..... 205/574, 580

[56] References Cited

U.S. PATENT DOCUMENTS

| | | | |
|---|---|---|---|
| 5,458,746 | 10/1995 | Burgess et al. | 204/106 |
| 5,516,408 | 5/1996 | Peckham et al. | 205/580 |
| 5,520,792 | 5/1996 | Burgess et al. | 205/74 |
| 5,670,033 | 9/1997 | Burgess et al. | 205/74 |

FOREIGN PATENT DOCUMENTS

| | | |
|---|---|---|
| 2001454 | 9/1969 | France . |
| 2138491 | 5/1990 | Japan . |
| 1 207 415 | 9/1970 | United Kingdom . |
| 1 224 736 | 3/1971 | United Kingdom . |
| WO 97/14825 | 4/1997 | WIPO . |
| 9738771 | 10/1997 | WIPO . |

OTHER PUBLICATIONS

Eamon et al., "Plant Practices & Innovations at Magma Copper Company's San Manuel SX–EW Plant", TMS Symposium, New Orleans, Louisiana, pp. 1–17, Feb. 1991.

Database WPI, XP002096785, Derwent Publications Ltd., London, Great Britain, 1 page. Aug. 1990.

Database WPI, XP002096786, Derwent Publications Ltd., London, Great Britain, 1 page. Oct. 1989.

International Search Report, International Application No. PCT/US98/26943, dated Mar. 25, 1999.

*Primary Examiner*—Edna Wong

*Attorney, Agent, or Firm*—Michael A. Centanni

[57] ABSTRACT

This invention relates to a low density high surface area copper powder having an apparent density in the range of about 0.20 to about 0.60 gram per cubic centimeter, and a surface area of at least about 0.5 square meter per gram. This invention also relates to an electrodeposition process for making the foregoing copper powder by electrodepositing the copper powder from an electrolyte solution using a critical combination of process parameters. These critical parameters include: a copper ion concentration for the electrolyte solution in the range of about 2 to about 7 grams per liter; a free chloride ion concentration for the electrolyte solution in the range of about 8 to about 20 ppm; an impurity level for the electrolyte solution of no more than about 1.0 gram per liter; and an electrolyte solution that is free of organic additives.

19 Claims, 3 Drawing Sheets

LOW DENSITY HIGH SURFACE AREA COPPER POWDER AND ELECTRODEPOSITION PROCESS FOR MAKING SAME

TECHNICAL FIELD

This invention relates to a low density high surface area copper powder, and to an electrodeposition process for making the same.

BACKGROUND OF THE INVENTION

Copper powder can be used in powder metallurgy applications to make sintered products. The copper powder is typically blended with iron or graphite powders, often in combination with alloying powders such as tin. It is then compacted and sintered to make the desired product. While this technology has been used widely for many years, there is a continuing need for higher strength products. A problem with obtaining such higher strength products relates to the fact that the sintering process used to make these products inherently produces products with relatively high concentrations of voids. The present invention offers a solution to this problem by providing copper powders having lower apparent densities than the those currently available. The copper powders of the present invention have apparent densities in the range of about 0.20 to about 0.60 grams per cubic centimeter. Currently available low density copper powders, on the other hand, generally have apparent densities in excess of about 0.65 grams per cubic centimeter and typically in excess of about 0.8 gram per cubic centimeter. The low density copper powders provided by this invention permit a more intimate contacting between the copper powder and the powders (e.g., iron, powders, graphite powders, etc.) they are blended with during compacting and sintering. This more intimate contacting allows for higher strength products having lower void concentrations.

U.S. Pat. Nos. 5,458,746; 5,520,792; and 5,670,033 disclose a process for making copper metal powder from copper-bearing material, comprising: (A) contacting said copper-bearing material with an effective amount of at least one aqueous leaching solution to dissolve copper ions in said leaching solution and form a copper-rich aqueous leach solution; (B) contacting said copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution, said extractant comprising (i) at least one oxime characterized by a hydrocarbon linkage with at least one —OH group and at least one ═NOH group attached to different carbon atoms on said hydrocarbon linkage, (ii) at least one betadiketone, or (iii) at least one ion-exchange resin; (C) separating said copper-rich extractant from said copper-depleted aqueous leaching solution; (D) contacting said copper-rich extractant with an effective amount of at least one aqueous stripping solution to transfer copper ions from said extractant to said stripping solution to form a copper-rich stripping solution and a copper-depleted extractant; (E) separating said copper-rich stripping solution from said copper-depleted extractant to form an electrolyte solution; (F) advancing said electrolyte solution to an electrolytic cell equipped with at least one anode and at least one cathode, and applying an effective amount of voltage across said anode and said cathode to deposit copper metal powder on said cathode; and (G) removing copper metal powder from said cathode.

U.S. Pat. No. 5,516,408 discloses a process for making copper wire directly from a copper-bearing material, comprising: (A) contacting said copper-bearing material with an effective amount of at least one aqueous leaching solution to dissolve copper ions into said leaching solution and form a copper-rich aqueous leaching solution; (B) contacting said copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution; (C) separating said copper-rich extractant from said copper-depleted aqueous leaching solution; (D) contacting said copper-rich extractant with an effective amount of at least one aqueous stripping solution to transfer copper ions from said extractant to said stripping solution to form a copper-rich stripping solution and a copper-depleted extractant; (E) separating said copper-rich stripping solution from said copper-depleted extractant; (F) flowing said copper-rich stripping solution between an anode and a cathode, and applying an effective amount of voltage across said anode and said cathode to deposit copper on said cathode; (G) removing said copper from said cathode; and (H) converting said removed copper from (G) to copper wire at a temperature below the melting point of said copper. In one embodiment the copper that is deposited on the cathode during step (F) is in the form of copper powder, and the process includes (H-1) extruding the copper powder to form copper rod or wire and (H-2) drawing the copper rod or wire to form copper wire with a desired cross-section.

The article by I. D. Enchev et al, "Production of Copper Powder by the Method of Electrolytic Extraction Using a Reversing Current", Porosbkovaya Metallurgiya, No. 9 (141), September, 1974, pp. 95–98, discloses the results of an investigation into the production of copper from electrolytes prepared from lean ore solutions by ion exchange and reversing electrolytic extraction. Electrolyte solutions prepared by leaching ore wastes and subsequent extraction with ABF dissolved in kerosene were used. The article reports the following optimum conditions for the electrolytic extraction of copper powder: reversing current density of 1200 $A/m^2$, durations of the normal and reversed polarity periods of 5 and 1 minute, respectively; electrolyte acidity and temperature of 100–160 grams per liter and 40–50° C., respectively; copper ion concentration of 10 grams per liter; graphite anodes and titanium cathodes; and powder particle size of 100 microns at a purity of 99.95% copper. The reference also indicates that the electrolyte solution that was tested had a chlorine content of 0.01 gram per liter (10 ppm) and an iron content of 0.90–1.20 gram per liter.

SUMMARY OF THE INVENTION

This invention relates to a low density high surface area copper powder having an apparent density in the range of about 0.20 to about 0.60 gram per cubic centimeter, and a surface area of at least about 0.5 square meter per gram. This invention also relates to an electrodeposition process for making the foregoing copper powder by electrodepositing the copper powder from an electrolyte solution using a critical combination of process parameters. These critical parameters include: a copper ion concentration for the electrolyte solution in the range of about 2 to about 7 grams per liter; a free chloride ion concentration for the electrolyte solution in the range of about 8 to about 20 ppm; an impurity level for the electrolyte solution of no more than about 1.0 gram per liter; and an electrolyte solution that is free of organic additives.

BRIEF DESCRIPTION OF THE DRAWINGS

In the annexed drawings, like references indicate like parts or features.

DESCRIPTION OF THE PREFERRED EMBODIMENTS

The low density high surface area copper powder provided for in accordance with this invention has a unique combination of properties which makes it particularly suitable for a wide range of applications, especially powder metallurgy applications. These properties are achieved as a result of the process used for making such powder which involves electrodepositing the powder from an electrolyte solution using a critical combination of process parameters which are referred to above and discussed in greater detail below.

The Copper Powder

Figure 3:
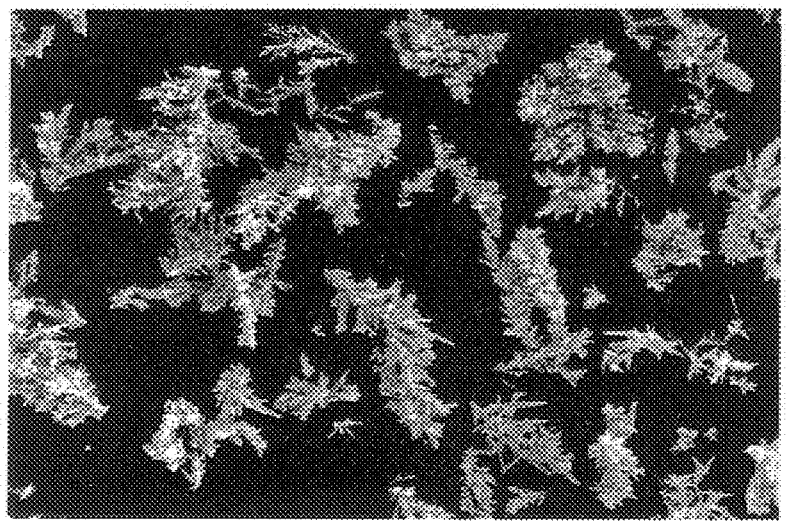
FIG. 3 is a photomicrograph of a sample of the copper powder produced in accordance with Example 3 taken at a magnification factor of 500×.
Figure 4:
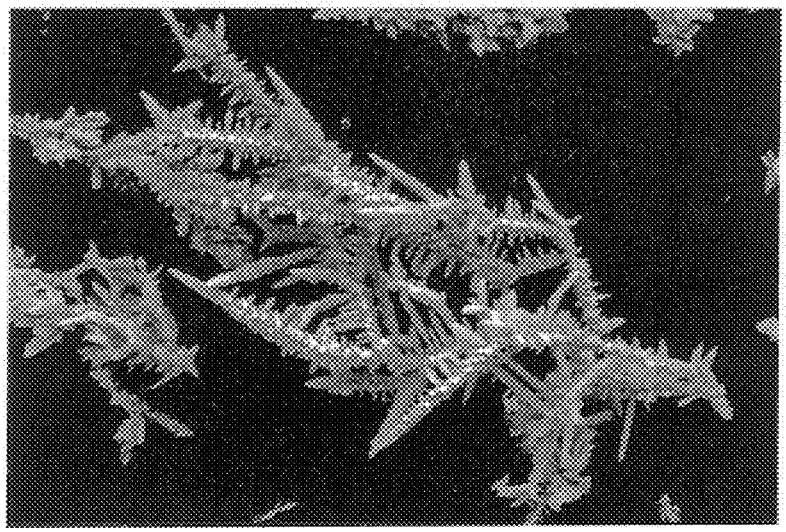
FIG. 4 is a photomicrograph of a sample of the copper powder produced in accordance with Example 3 taken at a magnification factor of 1500×.
Figure 5:
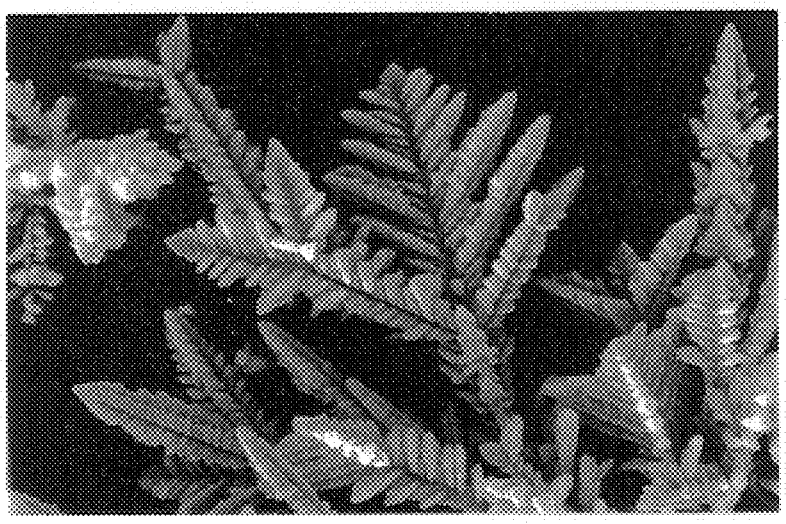
FIG. 5 is a photomicrograph of a sample of the copper powder produced in accordance with Example 3 taken at a magnification factor of 3000×.

The copper powder provided by this invention is a low density high surface area powder. This copper powder is characterized by dendritic growth and branching. In one embodiment, the powder is characterized by secondary and tertiary dendrite branching. In one embodiment, the inventive copper powder has a regular and symmetrical growth of dendritic branches about a common spine; see, FIGS. 3–5 and especially FIG. 5.

The copper powder has an apparent density in the range of about 0.20 to about 0.60 grams per cubic centimeter, and in one embodiment about 0.30 to about 0.60 grams per cubic centimeter, and in one embodiment about 0.30 to about 0.50 grams per cubic centimeter. Apparent density is measured using ASTM Test Method B703.

This copper powder has a surface area of at least about 0.5 square meters per gram, and in one embodiment about 0.5 to about 5 square meters per gram, and in one embodiment about 0.5 to about 2 square meters per gram, and in one embodiment about 0.5 to about 1.5 square meters per gram, and in one embodiment about 0.5 to about 1 square meter per gram. Surface area is measured using the BET (Bennett, Edward, Teller) procedure.

In one embodiment, the mean particle size for the copper powder is in the range of about 5 to about 50 microns, and in one embodiment about 10 to about 35 microns, and in one embodiment about 15 to about 30 microns. In one embodiment, at least about 90% by weight of the powder has a particle size that is smaller than about 75 microns; at least about 50% by weight of the powder has a particle size that is smaller than about 25 microns; and at least about 10% by weight of the powder has a particle size that is smaller than about 10 microns. Particle size is measured using ASTM Test Method B822.

In one embodiment, the copper powder has a green density in the range of about 4 to about 8 grams per cubic centimeter, and in one embodiment about 5.4 to about 6.3 grams per cubic centimeter.

In one embodiment, the copper powder has a green strength in the range of about 3,500 to about 7,000 psi, and in one embodiment about 4,500 to about 6,500 psi. Green strength is measured using ASTM Test Method B312.

The copper powder, as plated, is non-free flowing as defined in ASTM Test Method B417. It is to be understood, however, that subsequent treatment to the powder (e.g., agglomerating, etc.,) following plating can render the powder flowable.

The copper powder has a copper content of at least about 99% by weight, and in one embodiment at least about 99.2% by weight, and in one embodiment at least about 99.8% by weight, and in one embodiment at about 99.9% by weight, and in one embodiment at least about 99.99% by weight.

The foregoing properties of the copper powder of this invention are determined when the powder is in an as plated form after washing and drying. The term "as plated" refers to the copper powder after it is removed from cathode prior to any subsequent sintering, milling, sieving or blending operations that the powder might undergo. As plated copper powder includes copper powder that has been washed and dried subsequent to being removed from the cathode. As plated copper powder also includes copper powder that has agglomerated and the agglomerates have been broken.

The inventive copper powders have a wide variety of uses. They are useful in powder metallurgy applications for enhancing the properties of iron blends, bronze blends, and the like. The term "iron blend" is used herein to refer to blends of elemental powder containing mostly iron. The iron blends may also contain other powder elements such as C, Ni, Mo, Ag, and the like, as well as small amounts of one or more lubricants which are typically in dry powder form. The term "bronze blend" is used herein to refer blends of elemental Cu and Sn powders. The bronze blends may contain other powder elements such as C and well as small amounts of one or more lubricants which are typically in dry powder form. The inventive copper powders are useful as additives for enhancing the green strength of the foregoing powder blends prior to sintering as well as improving mechanical properties such as strength of the sintered products. The powder blends are typically placed in a press to shape a part; the part is then sintered and thereafter may be subjected to known secondary operations to produce the desired final product. The final product is sometimes referred to as an iron (or steel) or bronze powder metallurgy (P/M) part. The iron blends typically employ the inventive copper powders at concentrations of about 1% to about 3% by weight. The bronze blends typically employ the inventive copper powders at concentrations of about 85% to about 95% by weight.

The inventive copper powders can be combined with graphite and optionally organic binders to make engine, generator and household appliance brushes. The low density high surface area characteristics of the copper powder provides for enhanced bond strength between the graphite particles. These products typically employ the inventive copper powder at a level of about 20% to about 80% by weight, and in one embodiment about 30% to about 70% by weight.

The copper powders are useful in making friction materials such as brakes, clutches, and the like, where the low density high surface area characteristics of powder permits the use of smaller concentrations of copper powder and higher concentrations of the friction materials (e.g., silica, aluminum oxide, etc.). These friction materials typically employ the inventive copper powder at a level of about 30% about 90% by weight, and in one embodiment about 40% to about 60% by weight.

The inventive copper powders are useful as lubricant and food additives. They are useful in making products having high conductively applications, both thermal and electrical. They are useful in making kinetic energy penetrators and as biocidal additives for paints and polymers. The inventive copper powders are useful in metal injection molding operations and in making thermal management devices. They are useful in conductive paste applications and as additives for conductive polymer compositions. They are useful as alloying additives in metallurgical applications. They are useful in making extruded products or as an additive to powder feedstocks for making extruded products. They are particularly suitable for conversion to cupric oxide and cuprous oxide.

Electrodeposition Process

In one embodiment, the inventive copper powder is formed using an electrodeposition process which employs as the copper feedstock any conventional copper feedstock used for electrodepositing copper, including copper shot, scrap copper metal, scrap copper wire, recycled copper, cupric oxide, cuprous oxide, and the like. In this embodiment, the copper powder is electrodeposited in an electroforming cell equipped with a plurality of cathodes and anodes. Typically the cathodes are vertically mounted, have flat surfaces, and have square or rectangular shapes. The anodes are adjacent to the cathodes and are typically in the form of flat plates having the same shape as the cathodes. The gap between the cathodes and the anodes is typically from about 1 to about 4 inches, and in one embodiment about 1.5 to about 3 inches, and in one embodiment about 1.75 inches. The anode is a dimensionally stable anode that is made of, for example, lead, lead alloy, or titanium coated with a platinum family metal (i.e., Pt, Pd, Ir, Ru) or oxide thereof. The cathode is constructed of titanium and typically has smooth surfaces on each side for receiving the electrodeposited copper powder. The electrolyte solution is formed by dissolving the copper feedstock in sulfuric acid.

The electrolyte solution flows in the gaps between the anodes and cathodes, and an electric current is used to apply an effective amount of voltage across the anodes and the cathodes to deposit copper on the cathodes. The electric current can be a direct current or an alternating current with a direct current bias. The flow rate of the electrolyte solution through the electroforming cell is generally in the range of about 0.01 to about 0.3 gallons per minute per square foot of immersed cathode surface area (gpm/csa), and in one embodiment about 0.1 to about 0.2 gpm/csa. The electrolyte solution has a free sulfuric acid concentration generally in the range of about 100 to about 200 grams per liter, and in one embodiment about 120 to about 190 grams per liter, and in one embodiment about 165 to about 185 grams per liter. In one embodiment, the temperature of the electrolyte solution in the electroforming cell is critical and is in the range of about 15° C. to about 35° C., and in one embodiment about 20° C. to about 30° C. The copper ion concentration is critical and is in the range of about 2 to about 7 grams per liter, and in one embodiment 3 to about 6 grams per liter, and in one embodiment about 4 to about 6 grams per liter, and in one embodiment about 5 grams per liter. The free chloride ion concentration in the electrolyte solution is also critical and is in the range of about 8 to about 20 parts per million (ppm), and in one embodiment about 8 ppm to about 15 ppm, and in one embodiment about 8 ppm to about 12 ppm, and in one embodiment about 10 ppm. The current density is in the range of about 80 to about 120 amps per square foot (ASF), and in one embodiment about 90 to about 110 ASF, and in one embodiment about 100 ASF.

The impurity level in the electrolyte solution is critical and is maintained at a level of no more than about 1.0 gram per liter, and in one embodiment no more than about 0.8 gram per liter, and in one embodiment no more than about 0.6 gram per liter, and in one embodiment no more than about 0.4 gram per liter, and in one embodiment no more than about 0.2 gram per liter, and in one embodiment no more than about 0.1 gram per liter. The term "impurity" refers to any material that is not intentionally added to the electrolyte solution during the electrodeposition step of the inventive process. Included among the impurities that are to be avoided, or limited as indicated above, are iron, nickel, bismuth, tin, lead, antimony , arsenic, zinc, silver, sodium, nitrates, and the like. In one embodiment, it is critical that the concentration of iron be maintained at a level of no more than about 0.2 gram per liter, and in one embodiment no more than about 0.1 gram per liter.

It is critical that the electrolyte solution be maintained free of organic additives. The term "organic additive" refers to any organic material that is intentionally added to the electrolyte solution for the purpose of altering the properties or characteristics of the copper powder. Examples of the organic additives that are to be avoided include: gelatins derived from collagen such as animal glue; organic sulfur-containing materials such as the thioureas and the isothiocyanates (e.g., thiourea, thiosinamine (allylthiourea), thiosemicarbazide, etc.); organic sulfonates such as ammonium lignosulfonate; and the triazoles such as benzotriazole and the substituted benzotriazoles including the alkyl substituted benzotriazoles (e.g., tolyltriazole, ethylbenzotriazole, hexylbenzotriazole, octylbenzotriazole, etc.) aryl-substituted benzotriazole (e.g., phenylbenzotriazoles, etc.) and alkaryl- or arylalk-substituted benzotriazole, and substituted benzotriazoles wherein the substituents may be, for example, hydroxy, mercapto, alkoxy, halo (e.g., chloro), nitro, carboxy or carbalkoxy. Minor or trace amounts of the foregoing organic materials may appear as impurities in the electrolyte solution, but the amount of such organic material is maintained below about 0.5 ppm, and in one embodiment below about 0.05 ppm.

Electrodeposition is conducted until the desired build up of copper powder on the cathodes is achieved. In one embodiment, electrodeposition is continued for about 1 to about 5 hours, and in one embodiment about 1 to about 3 hours, and in one embodiment about 1.5 to about 2.5 hours. Electrodeposition is then discontinued and the powder is removed from the cathodes. The powder can be removed from the cathodes by brushing or scraping or using vibration or other mechanical and/or electrical techniques known in the art. The powder can be removed by reversing the current on the cathodes. The powder can be removed by spraying water or electrolyte onto the cathodes as the cathodes are lifted out of the electroforming cell, or by spraying electrolyte onto the cathodes without removing them from the cell. The powder can be separated from the cathodes by inducing turbulent flow in the electrolyte, or by mechanically scraping the powder from the cathodes. The powder can be separated by vibrating the cathode using ultrasonic energy or by manually or mechanically pounding on the cathode.

In one embodiment, the copper powder that is separated from the cathodes is washed sufficiently to remove electrolyte from the powder. Various methods can be employed to wash the powder. One method involves washing the powder and then dewatering it using a centrifuge. During this process antioxidants can be added to prevent or reduce oxidation. The antioxidants that can be added include ammonium hydroxide. These antioxidants are added to the wash water at a sufficient concentration to provide the wash water with a pH of about 7 to about 14, and in one embodiment a pH of about, 9. In one embodiment, antioxidants are added at a concentration of about 0.2 to about 0.9 gram per liter of wash water, and in one embodiment about 0.4 to about 0.6 gram per liter.

In one embodiment, an effective amount of a stabilizer is adhered to the surface of the copper powder for the purpose of reducing oxidation and increasing shelf life. The stabilizer is preferably added to the wash water and applied to the surface of the copper powder during washing. Examples of the stabilizers that can be used include the triazoles such as benzotriazole and substituted benzotriazoles. The substituted triazoles include alkyl-substituted benzotriazole (e.g., tolyltriazole, ethylbenzotriazole, hexylbenzotriazole, octylbenzotriazole, etc.) aryl-substituted benzotriazole (e.g., phenylbenzotriazole, etc.), and alkaryl- or arylalk-substituted benzotriazole, and substituted benzotriazoles wherein the substituents may be, for example, hydroxy, mercapto, alkoxy, halo (e.g., chloro), nitro, carboxy or carbalkoxy. The alkylbenzotriazoles include those in which the alkyl group contains 1 to about 20 carbon atoms, and in one embodiment 1 to about 8 carbon atoms. Benzotriazole is especially useful. The concentration of these triazoles in the wash water is, in one embodiment up to about 10,000 ppm, and in one embodiment from 0.5 to about 1000 ppm, and in one embodiment from 0.5 to about 500 ppm, and in one embodiment from about 0.5 to about 70 ppm.

In one embodiment, a surfactant is added to the wash water to enhance the wetting of the copper powder and/or enhance dispersion of stabilizers in the wash water. In one embodiment, the surfactant is a nonionic surfactant. The surfactants that can be used include the block copolymers of ethylene oxide and propylene oxide generally available for surfactant applications. These are sometimes referred to as alkoxylated alcohols. Examples of commercially available surfactants that can be used include those available from Olin under the trade designation POLY-TERGENT®. Specific examples include POLY-TERGENT®, S-505LF (a nonionic, low foaming surfactant identified as a block copolymer of ethylene oxide and propylene oxide). The concentration of the surfactant in the wash water is generally in the range up to about 500 ppm, and in one embodiment about 5 to about 500 ppm, and in one embodiment about 100 to about 500 ppm, and in one embodiment about 150 to about 250 ppm.

In one embodiment, the copper powder is washed using an antioxidant containing wash water in a first step, and then washed again using a stablizer-containing wash water which optionally can also contain a surfactant.

The dewatered copper powder is then dried using conventional copper powder drying techniques. The drying techniques that can be used include vacuum drying, flash drying, fluidized bed drying, rotary kiln/multi hearth drying, or freeze drying. The copper powder can be dried at a temperature of about 25 to about 125° C., and in one embodiment about 25 to about 85° C., and in one embodiment about 45 to about 55° C. The copper powder can be dried in air, in an inert atmosphere, or in a vacuum at an absolute pressure in the range of about 0.1 to about 760 mmHg, and in one embodiment 1 to about 250 mmHg, and in one embodiment about 3 to about 10 mmHg. Agglomerates that form during drying can be broken using known agglomerate breaking techniques. For example, screens, cage mills, cascading screens, and the like, can be used. The powder can be separated into desired size fractions using standard separation techniques such as screening and then collected and packaged.

The apparent density of the powder can be increased, if desired, by blending it with higher density powders, or by milling (e.g., hammer mill) or rolling the powder. These and similar techniques are known in the art.

Figure 1:
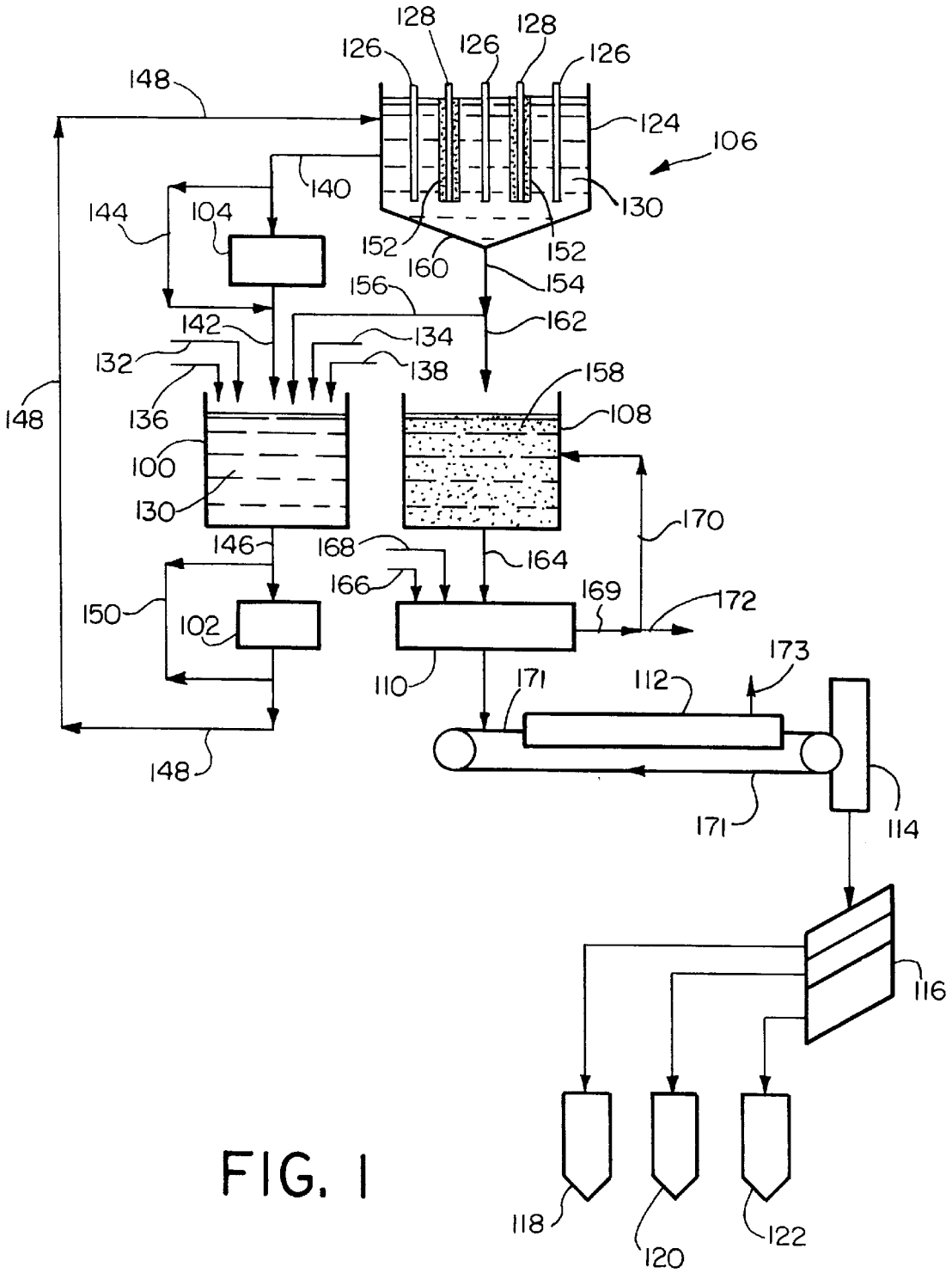
FIG. 1 is a flow sheet illustrating one embodiment of the inventive electrodeposition process used to make the inventive copper powder.

Referring now to FIG. 1, a process for electrodepositing the copper powder of the invention is disclosed. The apparatus used with this process includes a dissolution vessel 100, filters 102 and 104, an electroforming cell 106, holding vessel 108, centrifuge 110, drier 112, agglomerate breaker 114, screens 116, and storage hoppers 118, 120 and 122. The electroforming cell 106 includes vessel 124, vertically mounted anodes 126, and vertically mounted cathodes 128. An electrolyte solution 130 is formed in dissolution vessel 100 by dissolving the copper feedstock in sulfuric acid in the presence of air. The copper metal enters vessel 100, as indicated by directional arrow 132, in any conventional form which, as indicated above, includes copper shot, scrap copper metal, scrap copper wire, recycled copper, cupric oxide, cuprous oxide, and the like. The sulfuric acid entering vessel 100, as indicated by directional arrow 134, typically has a sulfuric acid concentration in the range of about 93% to about 98%. Alternatively, the copper feedstock can be dissolved in the sulfuric acid in a separate vessel to form a solution and this solution can then be advanced to vessel 100. Chloride ions can be added as indicated by directional arrow 136. In one embodiment, chloride ions are added in the form of hydrochloric acid. Dilution water can be added as indicated by directional arrow 138. Electrolyte solution recycled from electroforming cell 106, through lines 140 and 142, also enters vessel 100. The electrolyte may be filtered in filter 104 or it may by-pass filter 104 through line 144. The temperature of the electrolyte solution 130 in vessel 100 is typically in the range of about 15° C. to about 35° C., and in one embodiment about 20° C. to about 30° C. The electrolyte solution 130 is advanced from vessel 100 to vessel 124 through lines 146 and 148. The electrolyte solution 130 may be filtered in filter 102 prior to entering vessel 124 or, alternatively, it may by-pass filter 102 using line 150. Impurities can be removed using filters 102 and/or 104. The electrolyte solution 130 used in vessel 108 has the composition indicated above.

The electrolyte solution 130 flows between the anodes 126 and cathodes 128. The flow rate of the electrolyte through electroforming cell 106 is at a rate in the range of about 0.01 to about 0.3 gpm/csa, and in one embodiment about 0.1 to about 0.2 gpm/csa. A voltage is applied between anodes 126 and cathodes 128 to effect electrodeposition of copper powder 152 on each side of the cathodes. In one embodiment, the current that is used is a direct current, and in one embodiment it is an alternating current with a direct current bias. The current density is in the range of about 80 to about 120 ASF, and in one embodiment about 100 ASF. Electrodeposition of copper powder 152 on cathodes 128 is continued until the desired amount of copper powder has deposited on the cathodes. Electrodeposition is typically continued for about 1 to about 5 hours, and in one embodiment about 1 to about 3 hours, and in one embodiment about 1.5 to about 2.5 hours. Electrodeposition is then discontinued. Spent electrolyte solution 130 is drained from vessel 124 and advanced to vessel 100 through lines 154 and 156.

The copper powder 152 is separated from the cathodes 128 by spraying electrolyte on to the cathode resulting in the formation of a slurry 158 in the lower cone shaped section 160 of vessel 124. The slurry 158 is advanced from vessel 124 to vessel 108 through lines 154 and 162. The slurry 158 is then advanced from vessel 108 to centrifuge 110 through line 164. In centrifuge 110, liquid effluent is separated from the copper powder and exits centrifuge 110 through line 169 and is either recycled to vessel 108 through line 170, or removed through line 172 where it is discarded or subjected to further processing. In one embodiment, an antioxidant is added to the powder in the centrifuge as indicated by directional arrow 166. In one embodiment, a stabilizing agent is added to the powder in the centrifuge as indicated by directional arrow 168. In one embodiment, the antioxidant and stabilizing agent are added to the powder in the centrifuge in sequential order with the antioxidant preceding the stabilizing agent. When the antioxidant and/or stabilizing agent is added to the powder in centrifuge 110, the centrifuge is rotated at a sufficient rate to place a centrifugal force of about 2 to about 750 g's on its contents, and in one embodiment about 10 to about 200 g's, and in one embodiment about 10 to about 75 g's, and in one embodiment about 10 to about 20 g's until the pH of the effluent is in the range of about 7 to about 14, and in one embodiment about 7 to about 11, and in one embodiment about 9. The rotation rate of the centrifuge is then increased to dewater the copper powder. During this dewatering step, the rotation rate of the centrifuge is increased to a sufficient level to place a centrifugal force on its contents in the range of about 200 to about 750 g's, and in one embodiment about 500 to about 750 g's, and in one embodiment about 650 to about 700 g's. The copper powder remaining in the centrifuge 110 after dewatering is advanced to continuous belt 171 which conveys the powder through drier 112. Moisture is removed from the copper powder in drier 112 as indicated by directional arrow 173. The dried copper powder exits drier 112 and enters agglomerates breaker 114 wherein agglomerates that form during drying are broken. The powder is advanced from aggolmerate breaker 114 to screens 116 wherein the copper powder is separated into desired screen fractions and then advanced to storage hoppers 118, 120 and 122. Two screens and three storage hoppers are illustrated in FIG. 1, but those skilled in the art will recognize that any desired number of separation screens and storage hoppers can be used. In one embodiment, the use of separation screens is avoided due to the fact that the size of the copper powder produced by this method is relatively uniform.

The foregoing process can be conducted on a continuous basis or a batch basis. In one embodiment, the operation of the electroforming cell is conducted on a continuous basis, and the operation of the centrifuge is conducted on a batch basis.

The following examples are provided for purposes of illustrating the invention. Unless otherwise indicated, in the following example as well as throughout the specification and claims, all parts and percentages are by weight, all temperatures are in degrees Celsius, and all pressures are atmospheric.

EXAMPLES 1

An electroforming cell is used to electrodeposit copper powder from an electrolyte solution. The electrolyte solution is an aqueous solution having a copper ion concentration of 5 grams per liter, a sulfuric acid concentration of 150 grams per liter, and a free chloride ion concentration of 10 ppm. The cathodes have an immersed surface area of 32 inches wide and 36 inches long with plating occurring on both sides. The anodes have an immersed surface area of 36 inches wide and 38 inches long. Four cathodes and five anodes are used in the cell. The spacing between the anodes and cathodes is 1.75 inches. The inside dimensions of the cell are 48 inches long, 54 inches wide, and 50 inches deep to the beginning of a cone. The bottom of the cell is in the form of a cone to allow for copper powder collection in the bottom of the cone. Electrical (DC) current is fed to the cell to provide a current density of 100 ASF on the immersed surface area of the cathodes. The temperature of the electrolyte is 32° C. The cathode material of construction is titanium. The anodes are dimensionally stable anodes constructed of titanium coated with iridium oxide. The electrolyte flows through the cell at a rate of 0.17 gpm/csa. The plating time is three hours. The copper powder formed on the cathodes has an as plated mean particle size of 22 microns, a surface area of 0.7 square meters per gram, and an apparent density of 0.44 grams per cubic centimeter.

EXAMPLE 2

Copper powder is electrodeposited in an electroforming cell from an electrolyte solution having a copper ion concentration of 5 grams per liter, a sulfuric acid concentration of 150 grams per liter, and a free chloride ion concentration of 10 ppm. The spacing between the anodes and cathodes in the cell is 1.75 inches. The current density is 100 ASF. The temperature of the electrolyte is 22° C. The cathode material of construction is titanium. The anodes are dimensionally stable anodes constructed of titanium coated with iridium oxide. The electrolyte flows through the cell at a rate of 0.17 gpm/csa. The plating time is two hours. The copper powder formed on the cathodes is separated from the cathodes by spraying electrolyte on to the powder and the cathodes with the result being the formation of a slurry containing the powder. The slurry is advanced to a centrifuge. A solution of ammonium hydroxide having a pH of 10 is added to the slurry. The ratio of ammonium hydroxide solution to copper powder is 5 gallons of solution per pound of powder. The centrifuge is rotated at a sufficient rate to place a centrifugal force of 16 g's on the contents of the centrifuge. This is continued until two minutes after the effluent from the centrifuge attains a pH of 9. A stabilizing agent consisting of an aqueous solution of benzotriazole at a concentration of 20 ppm and POLY-TERGENT® S-505LF at a concentration of 200 ppm is then added. The ratio of stabilizing agent to powder is two gallons of stabilizing agent per pound of copper powder. The centrifuge is rotated at a sufficient rate to place a centrifugal force of 16g's on its contents. This is continued for two minutes after the effluent from the centrifuge attains a pH of 9. The rotation rate of the centrifuge is then increased to a sufficient level to place a centrifugal force of 674 g's on the contents of the centrifuge with the result being a dewatering of the copper powder. The copper powder is removed from the centrifuge, placed in a pan and dried overnight in a vacuum oven at a temperature of 50° C. and an absolute pressure of 3 mm Hg. The dried powder is screened to break up agglomerates and then packaged. The powder has the following properties:

B.E.T. Surface area: 0.60 $m^2/g$
Apparent density: 0.49 g/cc
Mean particle size: 27.77 microns
90% Smaller than: 68.52 microns
50% Smaller than: 15.91 microns
10% Smaller than: 5.67 microns
Green density @ 12 tsi: 6.0 g/cc Green strength @ 12 tsi: 4300 psi

EXAMPLE 3

Copper powder is electrodeposited in an electroforming cell from an electrolyte solution having a copper ion concentration of 5 grams per liter, a sulfuric acid concentration of 150 grams per liter and a free chloride ion concentration of 10 ppm. The cathodes are made of titanium and have an immersed surface area that is 33 inches in width, 48 inches in length, and 0.25 inch in thickness with plating occurring on both sides. The anodes are dimensionally stable anodes constructed of titanium coated with iridium oxide. The anodes have an immersed surface area of 37 inches in width, 50 inches in length, and 0.25 inch in thickness. The electroforming cell contains 4 cathodes and 5 anodes. The spacing between the anodes and cathodes is 1.75 inches. The dimensions of the cell are 56 inches in length, 43 inches in width, and 89.75 inches in depth to the base of a cone-shaped bottom. Electric (DC) current is fed to the cell to provide a current density of 100 ASF on the immersed surface area of the cathodes. The temperature of the electrolyte is 22.8° C. The flow rate of the electrolyte through the cell is 0.11 gpm/csa. The plating time is two hours. The copper powder formed on the cathodes is separated from the cathodes by spraying electrolyte on to the powder and the cathodes with the result being the formation of a slurring containing the powder. The slurring is advanced to a centrifuge. A solution of ammonium hydroxide having a pH of 10 is added to the slurry. The ratio of ammonium hydroxide solution to copper powder is 5 gallons of solution per pound of powder. The centrifuge is rotated at a sufficient rate to place a centrifugal force of 33g's on its contents until two minutes after the effluent from the centrifuge attains a pH of 9. A stabilizing agent consisting of an aqueous solution of benzotriazole at a concentration of 20 ppm and POLY-TERGENT® S-505LF at a concentration of 200 ppm is then added. The ratio of stabilizing agent solution to powder is two gallons of stabilizing agent solution per pound of copper powder. The centrifuge is rotated at a sufficient rate to place a centrifugal force on its contents of 33g's until two minutes after the effluent from the centrifuge attains a pH of 9. The rotation rate of the centrifuge is then increased to a sufficient level to place a centrifugal force of 500 g's on the contents of the centrifuge with the result being a dewatering of the copper powder. The copper powder is placed in a pan and dried overnight in a vacuum oven at a temperature of 50° C. and an absolute pressure of about 3 mm Hg. The dried powder is screened to break up agglomerates and then packaged. The powder has the following properties:

B.E.T. Surface area: 0.915 $m^2/g$

Apparent density: 0.44 g/cc

Mean particle size: 21.26 microns

90% Smaller than: 36.07 microns

50% Smaller than: 18.82 microns

10% Smaller than: 8.90 microns

Green density @ 12 tsi: 5.68 g/cc

Green strength @ 12 tsi: 6282 psi

Photomicrographs of samples of the powder are taken at magnification factors of 500×, 1500× and 3000×. These photomicrographs are attached as FIGS. 3–5, respectively. These photomicrographs disclose a copper powder having a highly dendritic crystal structure characterized by a symmetrical growth of dendritic branches about a common spine.

Solvent Extraction/Electrodeposition Process

In one embodiment, the copper powder is formed in a process using solvent extraction in combination with electrodeposition. In this embodiment, the copper feedstock is any copper-bearing material from which copper may be extracted. These feedstocks include copper ore, smelter flue dust, copper cement, copper concentrates, copper smelter products, copper sulfate, and copper-containing waste. The term "copper-containing waste" refers to any solid or liquid waste material (e.g., garbage, sludge, effluent streams, etc.) that contains copper. These waste materials include hazardous wastes. Specific examples of wastes that can be used are copper oxides obtained from treating spent cupric chloride etchants.

The copper ore can be ore taken from an open pit mine. The ore is hauled to a heap-leaching dump which is typically built on an area underlain with a liner, such as a thick high-density polyethylene liner, to prevent loss of leaching fluids into the surrounding water shed. A typical heap-leaching dump has a surface area of, for example, about 125,000 square feet and contains approximately 110,000 tons of ore. As leaching progresses and new dumps are built on top of the old dumps, they become increasingly higher and eventually reach heights of, for example, about 250 feet or more. A network of pipes and wobbler sprinklers is laid on the surface of a newly completed dump and a weak solution of sulfuric acid is continuously sprayed at a rate of, for example, about 0.8 gallon per minute per 100 square feet of surface area. The leaching solution percolates down through the dump, dissolves copper in the ore, flows from the dump base as a copper-rich aqueous leach solution, drains into a collection pond, and is pumped to a feed pond for subsequent treatment using the inventive process.

With some mining operations in-situ leaching is used to extract copper values from copper ore. The copper-rich leach solution obtained by this process can be used in the inventive process as the copper-bearing material. In-situ leaching is useful when reserves of acid-soluble oxide ore lie beneath an open pit area and above the depleted portion of an underground mine or when a deposit is buried too deeply to be economically developed by open pit methods. Injection wells are drilled into this zone at a depth of, for example, about 1000 feet. The wells are cased with polyvinylchloride pipe, the bottom portion of which is slotted to allow solution into the ore. A leach solution of weak sulfuric acid is injected into each well at a rate dependent upon the permeability of the zone into which it is drilled. The solution percolates down through the ore zone, dissolves the copper minerals, and drains into a prepared collection area. The collection area can be, for example, haulage drifts of the underground mine. The copper-bearing aqueous leach solution that is produced is pumped to the surface by means of a corrosion-resistant pumping system where it is available for use as the copper-bearing material for the inventive process. Alternatively, the copper-bearing aqueous leach solution can be collected through wells that bring the solution to the surface.

In mining operations wherein both leach dumps and in-situ leaching are employed, the copper-bearing leach solution (sometimes referred to as a pregnant leach solution) from each can be combined and used as the copper-bearing material in the inventive process.

In this embodiment, the copper powder is made by the steps of: (A) contacting the copper-bearing material with an effective amount of at least one aqueous leaching solution to dissolve copper ions into said leaching solution and form a copper-rich aqueous leaching solution; (B) contacting the copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution; (C) separating the copper-rich extractant from the copper-depleted aqueous leaching solution; (D) contacting the copper-rich extractant with an effective amount of at least one aqueous stripping solution to transfer copper ions from said extractant to said stripping solution to form a copper-rich stripping solution and a copper-depleted extractant; (E) separating the copper-rich stripping solution from the copper-depleted extractant; (F) flowing the copper-rich stripping solution between an anode and a cathode, and applying an effective amount of voltage across the anode and the cathode to deposit copper metal powder on the cathode; and (G) removing the copper powder from the cathode.

The aqueous leaching solution used in step (A) of the inventive process is, in one embodiment, a sulfuric acid solution, halide acid solution (HCl, HF, HBr, etc.) or an ammonia solution. The sulfuric or halide acid solution generally has a sulfuric or halide acid concentration in the range of about 5 to about 50 grams per liter, and in one embodiment about 5 to about 40 grams per liter, and in one embodiment about 10 to about 30 grams per liter.

The ammonia solution generally has an ammonia concentration in the range of about 20 to about 140 grams per liter, and in one embodiment about 30 to about 90 grams per liter. The pH of this solution is generally in the range of about 7 to about 11, and in one embodiment about 8 to about 9.

The copper-rich aqueous leaching solution or pregnant leaching solution formed during step (A) generally has a copper ion concentration in the range of about 0.4 to about 5 grams per liter, and in one embodiment about 0.4 to about 3 grams per liter, and in one embodiment about 0.4 to about 1 gram per liter. When the leaching solution used in step (A) is a sulfuric acid solution, the concentration of free sulfuric acid in the copper-rich aqueous leaching solution is generally from about 5 to about 30 grams per liter, and in one embodiment about 10 to about 20 grams per liter. When the leaching solution used in step (A) is an ammonia solution, the concentration of free ammonia in the copper-rich aqueous leaching solution is generally from about 10 to about 130 grams per liter, and in one embodiment about 30 to about 90 grams per liter.

The water-insoluble extractant used in step (B) can be any water-insoluble extractant capable of extracting copper ions from an aqueous medium. In one embodiment the extractant is dissolved in a water-immiscible organic solvent. (The terms "water-immiscible" and "water-insoluble" refer to compositions that are not soluble in water above a level of about 1 gram per liter at 25° C.) The solvent can be any water-immiscible solvent for the extractant with kerosene, benzene, toluene, xylene, naphthalene, fuel oil, diesel fuel and the like being useful, and with kerosene being preferred. Examples of useful kerosenes are SX-7 and SX-12 which are available from Phillips Petroleum.

In one embodiment the extractant is an organic compound containing at least two functional groups attached to different carbon atoms of a hydrocarbon linkage, one of the functional groups being —OH and the other of said functional groups being =NOH. These compounds can be referred to as oximes. In one embodiment the extractant is an oxime represented by the formula

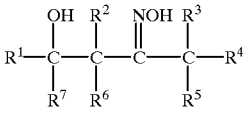

wherein $R^1$, $R^2$, $R^3$, $R^4$, $R^4$, $R^5$, $R^6$ and $R^7$ are independently hydrogen or hydrocarbyl groups. Compounds with this structure are available from Henkel Corporation under the trade designation LIX. For example, $R^1$ and $R^4$ can each be butyl; $R^2$, $R^3$ and $R^6$ can each be hydrogen; and $R^5$ and $R^7$ can each be ethyl. Compounds with this structure are available from Henkel Corporation under the trade designation LIX 63.

In one embodiment the extractant is an oxime represented by the formula

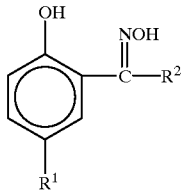

wherein $R^1$ and $R^2$ are independently hydrogen or hydrocarbyl groups. Useful embodiments include those wherein $R^1$ is an alkyl group of about 6 to about 20 carbon atoms, and in one embodiment about 9 to about 12 carbon atoms; and $R^2$ is hydrogen, an alkyl group of 1 to about 4 carbon atoms, and in one embodiment 1 or 2 carbon atoms, or $R^2$ is phenyl. The phenyl group can be substituted or unsubstituted with the latter being preferred. The following compounds, which are based upon the above-indicated formula, are available from Henkel Corporation under the trade designations indicated below and are useful with the inventive process:

| Trade Designation | $R^1$ | $R^2$ |
|---|---|---|
| LIX 65 | Nonyl | Phenyl |
| LIX 84 | Nonyl | Methyl |
| LIX 860 | Dodecyl | Hydrogen |

Other commercially available materials available from Henkel Corporation that are useful include: LIX 64N (identified as a mixture of LIX 65 and LIX 63); and LIX 864 and LIX 984 (identified as mixtures of LIX 860 and LIX 84).

In one embodiment the extractant is a betadiketone. These compounds can be represented by the formula

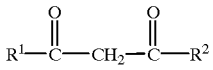

wherein $R^1$ and $R^2$ are independently alkyl groups or aryl groups. The alkyl groups generally contain 1 to about 10 carbon atoms. The aryl groups are generally phenyl. An example of a commercial extractant available from Henkel Corporation corresponding to the above formula is LIX 54. These betadiketones are useful when the leaching solution used in step (A) is an ammonia solution.

The concentration of the extractant in the organic solution is generally in the range of about 2% to about 40% by weight. In one embodiment the organic solution contains from about 5% to about 10%, or about 6% to about 8%, or about 7% by weight of LIX 984, with the remainder being SX-7.

In one embodiment the extractant is an ion-exchange resin. These resins are typically small granular or bead-like materials having of two principal parts: a resinous matrix serving as a structural portion, and an ion-active group serving as the functional portion. The functional group is generally selected from those functional groups that are reactive with copper ions. Examples of such functional groups include $—SO_3^-$, $—COO^-$,

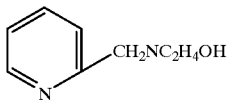

and

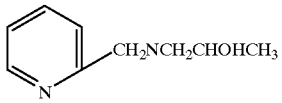

Useful resin matrixes include the copolymers of styrene and divinylbenzene. Examples of commercially available resins that can be used include IRC-718 (a product of Rohm & Haas identified as a tertiary amine substituted copolymer of styrene and divinylbenzene), IR-200 (a product of Rohm & Haas identified as sulfonated copolymer of styrene and divinylbenzene), IR-120 (a product of Rohm & Haas identified as sulfonated copolymer of styrene and divinylbenzene), XFS 4196 (a product of Dow identified as a macroporous polystyrene/divinylbenzene copolymer to which has been attached N-(2-hydroxyethyl)-picolylamine), and XFS 43084 (a product of Dow identified as a macroporous polystyrene/divinylbenzene copolymer to which has been attached N-(2-hydroxypropyl)-picolylamine). These resins are typically used in the inventive process as fixed beds or moving beds. During step (B) of the inventive process, the resin is contacted with the copper-rich aqueous leach solution from step (A), the contacting being sufficient to transfer copper ions from the leach solution to the resin. The copper-rich resin is then stripped during step (D) to provide a copper-stripped or copper-depleted resin which can be used during step (B).

The copper-rich extractant that is separated during step (C) has a concentration of copper in the range of about 1 to about 6 grams per liter of extractant, and in one embodiment about 2 to about 4 grams per liter of extractant. The copper-depleted aqueous leaching solution that is separated during step (C) typically has a copper ion concentration in the range of about 0.01 to about 0.8 grams per liter, and in one embodiment about 0.04 to about 0.2 grams per liter. When the leaching solution used in step (A) is a sulfuric acid solution, the concentration of free sulfuric acid in the copper-depleted aqueous leaching solution separated during step (C) is generally from about 5 to about 50 grams per liter, and in one embodiment about 5 to about 40 grams per liter, and in one embodiment about 10 to about 30 grams per liter. When the leaching solution used in step (A) is an ammonia solution, the concentration of free ammonia in the copper-depleted aqueous leaching solution separated during step (C) is generally from about 10 to about 130 grams per liter, and in one embodiment about 30 to about 90 grams per liter.

In one embodiment the contacting and separating steps (B) and (C) are conducted in two stages. In this embodiment, steps (B-1) and (B-2) are contacting steps, and steps (C-1) and (C-2) are separating steps. Thus, in this embodiment, the inventive process involves the following sequence of steps: (A), (B-1), (C-1), (B-2), (C-2), (D), (E), (F) and (G) with process streams from several of these steps being recirculated to other steps in the process. Step (B-1) involves contacting the copper-rich aqueous leaching solution formed during step (A) with an effective amount of at least one copper-bearing water-insoluble extractant from step (C-2) to transfer copper ions from said copper-rich aqueous leaching solution to said copper-bearing extractant to form a copper-rich extractant and a first copper-depleted aqueous leaching solution. Step (C-1) involves separating the copper-rich extractant formed during step (B-1) from the first copper-depleted aqueous leaching solution formed during step (B-1). The copper-rich extractant that is separated during step (C-1) generally has a concentration of copper in the range of about 1 to about 6 grams per liter of extractant, and in one embodiment about 2 to about 4 grams per liter of extractant. The first copper-depleted aqueous leaching solution that is separated during step (C-1) generally has a copper ion concentration in the range of about 0.4 to about 4 grams per liter, and in one embodiment about 0.5 to about 2.4 grams per liter. When the leaching solution used in step (A) is a sulfuric acid solution, the concentration of free sulfuric acid in the first copper-depleted aqueous leaching solution separated during (C-1) is generally from about 5 to about 50 grams per liter, and in one embodiment about 5 to about 30 grams per liter, and in one embodiment about 10 to about 30 grams per liter. When the leaching solution used in (A) is an ammonia solution, the concentration of free ammonia in the first copper-depleted aqueous leaching solution separated during step (C-1) is generally from about 10 to about 130 grams per liter, and in one embodiment about 30 to about 90 grams per liter.

Step (B-2) involves contacting the first copper-depleted aqueous leaching solution separated during step (C-1) with an effective amount of at least one copper-depleted extractant from step (E) to transfer copper ions from said first copper-depleted aqueous leaching solution to said copper-depleted extractant to form a copper-bearing extractant and a second copper-depleted aqueous leaching solution. Step (C-2) involves separating the copper-bearing extractant formed during step (B-2) from the second copper-depleted aqueous leaching solution formed during step (B-2). The copper-bearing extractant that is separated during step (C-2) generally has a concentration of copper in the range of about 0.4 to about 4 grams per liter of extractant, and in one embodiment about 1 to about 2.4 grams per liter of extractant. The second copper-depleted aqueous leaching solution that is separated during step (C-2) generally has a copper ion concentration in the range of about 0.01 to about 0.8 grams per liter, and in one embodiment about 0.04 to about 0.2 grams per liter. When the leaching solution used in step (A) is a sulfuric acid solution, the concentration of free sulfuric acid in the second copper-depleted aqueous leaching solution separated during step (C-2) is generally from about 5 to about 50 grams per liter, and in one embodiment about 5 to about 40 grams per liter, and in one embodiment about 10 to about 30 grams per liter. When the leaching solution used in step (A) is an ammonia solution, the concentration of free ammonia in the second copper-depleted aqueous leaching solution separated during step (C-2) is generally from about 10 to about 130 grams per liter, and in one embodiment about 30 to about 90 grams per liter.

The stripping solution used in step (D) of the inventive process is a sulfuric acid solution which has a free sulfuric acid concentration generally in the range of about 80 to about 300 grams per liter. In one embodiment, the free sulfuric acid concentration of the stripping solution used in (D) is about 100 to about 200 grams per liter, and in one embodiment about 150 to about 200 grams per liter.

The electrodeposition step (F) involves advancing the copper-rich stripping solution from step (E) into an electroforming cell and electrodepositing copper metal powder on the cathodes in the cell. The copper-rich stripping solution treated in the electroforming cell can be referred to as either a copper-rich stripping solution or an electrolyte solution. In one embodiment, this electrolyte solution is subjected to a purification or filtering process prior to entering the cell. The cell is operated in the same manner as the electroforming cell discussed above under the subtitle "Electrodeposition Process" with the result being the formation of the desired copper powder on the cathodes of such cell. The copper powder can be separated from the cathodes, and then washed and dried using the techniques discussed above.

The process will now be described with reference to FIG. 2, which is a flow sheet illustrating a solvent-extraction, electrodeposition process for making the inventive copper powder. In this process copper is extracted from copper leach dump 200 and treated in accordance with steps of the inventive process to produce the copper powder 152. The process involves the use of settlers 202, 204 and 206, collection pond 208, mixers 210, 212 and 214, vessel 101, electroforming cell 106, filters 102, 104 and 216, holding vessel 108, centrifuge 110, drier 112, agglomerate breaker 114, screens 116, and storage hoppers 118, 120 and 122. In this embodiment, step (A) of the inventive process is conducted at the leach dump 200. Steps (B) and (C) are conducted in two stages using mixers 210 and 212, and settlers 202 and 204. Steps (D) and (E) are conducted using mixer 214 and settler 206. Steps (F) and (G) are conducted using electroforming cell 106.

An aqueous leach solution from line 220 is sprayed on the surface of leach dump 200. The leach solution is a sulfuric acid solution having a free sulfuric acid concentration generally in the range of about 5 to about 50, and in one embodiment about 5 to about 40, and in one embodiment about 10 to about 30 grams per liter. The leach solution percolates down through the dump and extracts copper from the ore. The leach solution flows through dump space 222 as a copper-rich aqueous leach solution (sometimes referred to as a pregnant leach solution), and through line 224 into collection pond 208. The leach solution is pumped from collection pond 208 through line 226 to mixer 212. The copper-rich leach solution that is pumped to mixer 212 has a copper ion concentration generally in the range of about 0.4 to about 5, and in one embodiment about 0.4 to about 3 grams per liter; and a free sulfuric acid concentration generally in the range of about 5 to about 30, and in one embodiment about 10 to about 20 grams per liter. In mixer 212, the copper-rich aqueous leach solution is mixed with a copper-bearing organic solution which is pumped into mixer 212 through line 228 from weir 230 of settler 204. The concentration of copper in the copper-bearing organic solution that is added to mixer 212 is generally from about 0.4 to about 4 grams of copper per liter of extractant in the organic solution, and in one embodiment about 1 to about 2.4 grams of copper per liter of extractant in the organic solution. During the mixing in mixer 212, an organic phase and an aqueous phase form and intermix. Copper ions transfer from the aqueous phase to the organic phase. The mixture is pumped from mixer 212 through line 232 to settler 202. In settler 202, the aqueous phase and organic phase separate with the organic phase forming the top layer and the aqueous phase forming the bottom layer. The organic phase collects in weir 234 and is pumped through line 236 to mixer 214. This organic phase is a copper-rich organic solution (which can be referred to as a loaded organic). This copper-rich organic solution generally has a copper concentration in the range of about 1 to about 6 grams of copper per liter of extractant in the organic solution, and in one embodiment about 2 to about 4 grams of copper per liter of extractant in the organic solution.

The copper-rich organic solution is mixed in mixer 214 with a copper-depleted stripping solution. The copper-depleted stripping solution (which can be referred to as a lean electrolyte) is produced in the electroforming cell 106 and is pumped from the cell 106 through lines 237 and 238 to mixer 214. This copper-depleted stripping solution generally has a free sulfuric acid concentration in the range of about 80 to about 300, and in one embodiment about 150 to about 200 grams per liter; and a copper ion concentration in the range of generally about 2 to about 5, and in one embodiment about 2 to about 4 grams per liter. Fresh stripping solution make-up can be added to line 238 through line 240. The copper-rich organic solution and copper-depleted stripping solution are mixed in mixer 214 with the result being the formation of an organic phase intermixed with an aqueous phase. Copper ions transfer from the organic phase to the aqueous phase. The mixture is pumped from mixer 214 through line 242 to settler 206. In settler 206, the organic phase separates from the aqueous phase with the organic phase collecting in weir 244. This organic phase is a copper-depleted organic solution (which is sometimes referred to as a barren organic). This copper-depleted organic solution generally has a copper concentration in the range of about 0.5 to about 2 grams per liter of extractant in the organic solution, and in one embodiment about 0.9 to about 1.5 grams per liter of extractant in the organic solution. The copper depleted organic solution is pumped from settler 206 through line 246 to mixer 210. Fresh organic solution make-up can be added to line 246 through line 248.

Copper-containing aqueous leach solution is pumped from settler 202 through line 250 to mixer 210. This copper-containing aqueous leach solution has a copper ion concentration generally in the range of about 0.4 to about 4, and in one embodiment about 0.5 to about 2.4 grams per liter; and a free sulfuric acid concentration generally in the range of about 5 to about 50, and in one embodiment about 5 to about 30, and in one embodiment about 10 to about 20 grams per liter. In mixer 210, an organic phase and aqueous phase form, intermix and copper ions transfer from the aqueous phase to the organic phase. The mixture is pumped through line 252 to settler 204. In settler 204, the organic phase separates from the aqueous phase with the organic phase collecting in weir 230. This organic phase, which is a copper-containing organic solution, is pumped from settler 204 through line 228 to mixer 212. This copper-containing organic solution has a copper concentration generally in the range of about 0.5 to about 4 grams per liter of extractant in the organic solution, and in one embodiment about 1 to about 2.4 grams per liter of extractant in the organic solution. The aqueous phase in settler 204 is a copper-depleted aqueous leaching solution which is pumped through line 220, to the leach dump 200. Fresh leaching solution make-up can be added to line 220 from line 254.

The aqueous phase which separates out in settler 206 is a copper-rich stripping solution. This copper-rich stripping solution has a copper ion concentration generally in the range of about 5 to about 15 grams per liter, and in one embodiment about 7 to about 10 grams per liter; and a free sulfuric acid concentration generally in the range of about 50 to about 200, and in one embodiment about 150 to about 200 grams per liter. It is pumped from settler 206 through line 260 to filter 216 and from filter 216 through line 262 and then either: through line 264 to electroforming cell 106; or through line 140 to filter 104 and from filter 104 through line 142 to vessel 101. Filter 216 can be by-passed through line 217. Similarly, filter 104 can be by-passed through line 144. The copper-rich stripping solution entering electroforming cell 106 or vessel 101 can be referred to as electrolyte solution 130. If the composition of the electrolyte solution 130 requires adjustment (e.g., increase or decrease in copper ion concentration, etc.) the electrolyte solution is advanced to vessel 101 prior to being advanced to electroforming cell 106. If no adjustment in the composition of the electrolyte solution is required, the electrolyte solution is advanced directly to electroforming cell 106. In electroforming cell 106, the electrolyte solution 130 flows between anodes 126 and cathodes 128. When voltage is applied between the anodes 126 and cathodes 128, electrodeposition of copper powder 152 on each side of the cathodes 128 occurs.

In electroforming cell 106, electrolyte solution 130 is converted to a copper-depleted electrolyte solution and is withdrawn from cell 106 through line 237. The copper-depleted electrolyte solution in line 237 has a copper ion concentration generally in the range of about 2 to about 5 grams per liter, and in one embodiment about 2 to about 4 grams per liter; and a free sulfuric acid concentration generally in the range of about 80 to about 300 grams per liter, and in one embodiment about 150 to about 200 grams per liter. This copper-depleted electrolyte solution is either: (1) pumped through lines 237 and 140 to filter 104 (which optionally can be by-passed through line 144) and from filter 104 (or line 144) to line 142, through line 142 to vessel 101, and from vessel 101 through line 146 to filter 102, through filter 102 (which can be by-passed through line 150) to line 148 and through line 148 back to cell 106; or (2) pumped through line 237 to line 238 and through line 238 to mixer 214 as the copper-depleted stripping solution. Optionally, additional copper feedstock as indicated by directional arrow 131, sulfuric acid as indicated by directional arrow 132, chloride ions as indicated by directional arrow 133, or dilution water as indicated by directional arrow 134, can be added to the electrolyte solution in vessel 101. The additional copper feedstock entering vessel 101, can be in any conventional form which includes copper shot, scrap copper metal, scrap copper wire, recycled copper, cupric oxide, cuprous oxide, and the like. In one embodiment, the copper feedstock entering vessel 101 is initially dissolved in sulfuric acid in a separate vessel prior to being added to vessel 101. Also, impurities may be removed from the electrolyte solution 130 using either or both of filters 102 and 104. Electrolyte solution 130 recycled from electroforming cell 106 also enters vessel 101 through line 142. Spent electrolyte from cell 106 may be advanced to vessel 101 through lines 154 and 156. The temperature of the electrolyte solution 130 in vessel 101 is typically in the range of about 15° C. to about 40° C., and in one embodiment about 20° C. to about 30° C. The electrolyte solution 130 is advanced from vessel 101 to vessel 124 through lines 146 and 148. The electrolyte solution 130 may be filtered in filter 102 prior to entering vessel 124 or, alternatively, it may by-pass filter 102 through line 150.

The electrolyte solution 130 that is treated in the electroforming cell 106 has a free sulfuric acid concentration generally in the range of about 100 to about 200 grams per liter, and in one embodiment about 120 to about 190 grams per liter, and in one embodiment about 140 to about 185 grams per liter. The copper ion concentration is critical and is in the range of about 2 to about 7 grams per liter, and in one embodiment about 3 to about 6 grams per liter, and in one embodiment about 5 grams per liter. The free chloride ion concentration in the electrolyte solution is critical and is in the range of about 8 ppm to about 20 ppm, and in one embodiment about 8 ppm to about 15 ppm, and in one embodiment about 8 ppm to about 12 ppm, and in one embodiment about 10 ppm. The impurity level is critical and is at a level of no more than about 1.0 gram per liter, and in one embodiment no more than about 0.6 gram per liter, and in one embodiment no more than about 0.1 gram per liter. The temperature of the electrolyte solution in electroforming cell 106 is in the range of about 15° C. to about 35° C., and in one embodiment about 20° C. to about 30° C.

The flow rate of the electrolyte solution through the electroforming cell 106 is at a rate in the range of about 0.01 to about 0.3 gpm/csa, and in one embodiment about 0.1 to about 0.2 gpm/csa. The electrolyte solution 130 flows between the anodes 126 and cathodes 128. A voltage is applied between anodes 126 and cathodes 128 to effect electrodeposition of the copper powder 152 on to the cathodes 128. In one embodiment, the current that is used is a direct current, and in one embodiment it is an alternating current with a direct current bias. The current density is in the range of about 80 to about 120 ASP, and in one embodiment about 90 to about 110 ASF, and in one embodiment about 100 ASF. Electrodeposition of copper powder 152 on cathodes 128 is continued for about 1 to about 5 hours, and in one embodiment about 1 to about 3 hours, and in one embodiment about 1.5 to about 2.5 hours. Electrodeposition is then discontinued. Spent electrolyte solution 130 is drained from vessel 124 and advanced to vessel 101 through lines 154 and 156. The copper powder 152 is separated from the cathodes 128 by spraying electrolyte on to the cathode resulting in the formation of a slurry 158 in the lower cone shaped section 160 of vessel 124. The slurry 158 is advanced from vessel 124 to vessel 108 through lines 154 and 162. The slurry 158 is then advanced from vessel 108 to centrifuge 110 through line 164. In centrifuge 110, liquid effluent is separated from the copper powder and exits centrifuge 110 through line 169 and is either recycled to vessel 108 through line 170, or removed through line 172 where it is discarded or subjected to further processing. In one embodiment, an antioxidant is added to the powder in the centrifuge as indicated by directional arrow 166. In one embodiment, a stabilizing agent is added to the powder in the centrifuge as indicated by directional arrow 168. In one embodiment, the antioxidant and stabilizing agent are added to the powder in the centrifuge in sequential order with the antioxidant preceding the stabilizing agent. Alternatively, the antioxidant and/or stabilizing agent can be added to the slurry 158 in vessel 108. When the antioxidant and/or stabilizing agent is added to the powder in centrifuge 110, the centrifuge is rotated at a sufficient rate to place a centrifugal force of about 2 to about 750 g's on its contents, and in one embodiment about 10 to about 200 g's, and in one embodiment about 10 to about 75 g's, and in one embodiment about 10 to about 20 g's. The centrifuge is rotated until the pH of the effluent is in the range of about 7 to about 14, and in one embodiment about 7 to about 11, and in one embodiment about 9. The rotation rate of the centrifuge is then increased to dewater the copper powder. During this step, the rotation rate of the centrige is increased to a sufficient level to place a centrifugal force on its contents in the range of about 200 to about 750 g's, and in one embodiment about 500 to about 700 g's, and in one embodiment about 650 to about 700 g's. The copper powder remaining in the centrifuge 110 after dewatering is advanced to continuous belt 171 which conveys the powder through drier 112. Moisture is removed from the copper powder in drier 112 as indicated by directional arrow 173. The dried copper powder exits drier 112 and enters agglomerate breaker 114 wherein agglomerates that form during drying are broken. The powder is advanced from agglomerate breaker 114 to screens 116 wherein the copper powder is separated into desired screen fractions and then advanced to storage hoppers 118, 120 and 122.

The foregoing process can be conducted on a continuous basis or a batch basis. In one embodiment, the operation of the electroforming cell is conducted on a continuous basis, and the operation of the centrifuge is conducted on a batch basis.

EXAMPLE 4

Figure 2:
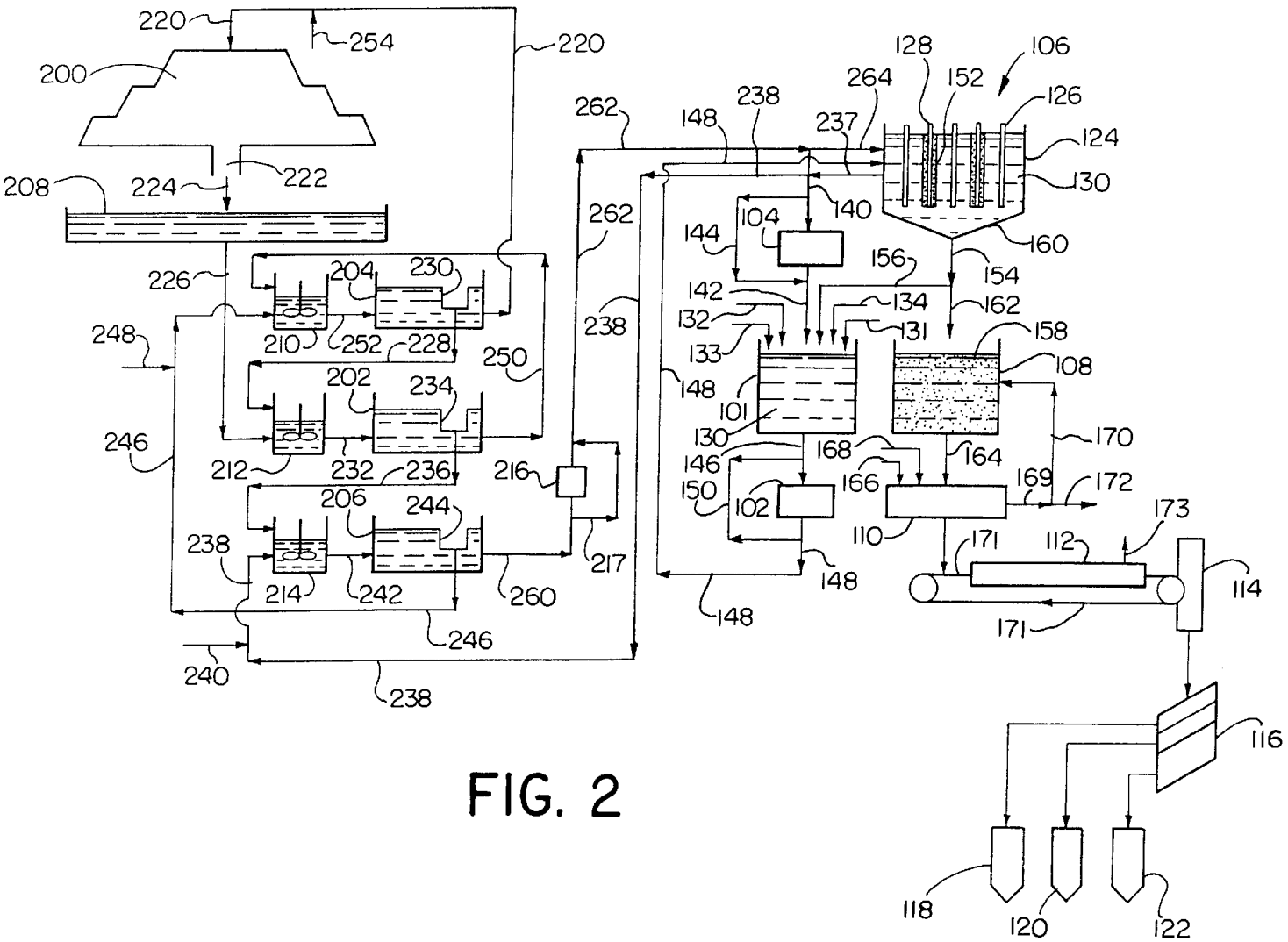
FIG. 2 is a flow sheet illustrating another embodiment of the inventive electrodeposition process used to make the inventive copper powder.

Copper powder 152 is made using the process illustrated in FIG. 2. The aqueous leaching solution sprayed on leach dump 200 from line 220 is a sulfuric acid solution having a sulfuric acid concentration of 20 grams per liter. The copper-rich aqueous leach solution that is pumped to mixer 212 through line 226 has a copper ion concentration of 1.8 grams per liter and a free sulfuric acid concentration of 12 grams per liter. The organic solution is a 7% by weight solution of LIX 984 in SX-7. The concentration of copper in, the copper-bearing organic solution that is added to mixer 212 from settler 204 has a copper concentration of 1.95 grams per liter. The copper-rich organic solution that is pumped to mixer 214 from settler 202 has a copper concentration of 3 grams per liter of LIX 984. The copper-depleted stripping solution added to mixer 214 from line 238 has a free sulfuric acid concentration of 175 grams per liter and a copper ion concentration of 4 grams per liter. The copper-depleted organic solution that is pumped from settler 206 to mixer 210 has a copper concentration of 1.25 grams per liter of LIX 984. The copper-containing aqueous leach solution pumped from settler 202 to mixer 210 has a copper ion concentration of 0.8 grams per liter and a free sulfuric acid concentration of 12 grams per liter. The copper-depleted aqueous solution pumped from settler 204 through line 220 has a copper concentration of 0.15 grams per liter and a free sulfuric acid concentration of 12 grams per liter. The copper-rich stripping solution taken from settler 206 has a copper ion concentration of 7 grams per liter and a free sulfuric acid concentration of 175 grams per liter. This copper-rich stripping solution is advanced to vessel 101 wherein the composition of such solution is adjusted to provide a copper ion concentration of 5 grams per liter, a free sulfuric acid concentration of 175 grams per liter, and a free chloride ion concentration of 10 ppm. The copper-rich stripping solution (which can be referred as electrolyte 130) is advance to electroforming cell 106. The temperature of the electrolyte solution in cell 106 is maintained at 24–27° C. The current density is 100 ASF. The cathode material of construction is titanium. The anodes are dimensionally stable anodes constructed of titanium coated with iridium oxide. The electrolyte flows through the cell 106 at a rate of 0.17 gpm/csa. The plating time is three hours. The copper powder formed on the cathodes is separated from the cathodes by spraying electrolyte on to the powder and the cathodes with the result being the formation of a slurring containing the powder. The slurry is advanced to vessel 108 and from there to centrifuge 110. A solution of ammonium hydroxide having a pH of 10 is added to the powder in the centrifuge. The ratio of ammonium hydroxide solution to copper powder is 5 gallons of solution per pound of powder. The centrifuge is rotated at a sufficient rate to place a centrifugal force of 16 g's on its contents until two minutes after the effluent from the centrifuge attains a pH of 9. A stabilizing agent consisting of an aqueous solution of benzotriazole at a concentration of 20 ppm and POLY-TERGENT S-505LF at a concentration of 200 ppm is then added. The ratio of stabilizing agent to powder is two gallons of stabilizing agent per pound of copper powder. The centrifuge is rotated at a sufficient rate to place a centrifugal force of 16 g's on its contents until two minutes after the effluent from the centrifuge attains a pH of 9. The rotation rate of the centrifuge is increased to a sufficient level to place a centrifugal force of 674 g's on the contents of the centrifuge with the result being a dewatering of the copper powder. The copper powder remaining in the centrifuge 110 after dewatering is advanced to continuous belt 171 which conveys the powder through drier 112. Moisture is removed form the copper powder in drier 112 as indicated by directional arrow 173. The dried copper powder exits drier 112 and enters agglomerate breaker 114 wherein agglomerates that formed during drying are broken. The powder is advanced from agglomerate breaker 114 to screens 116 wherein the copper powder is separated into desired screen fractions and then advanced to storage hoppers 118, 120 and 122.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for making copper powder having an apparent density in the range of about 0.20 to about 0.60 gram per cubic centimeter and a surface area of at least about 0.5 square meter per gram, said process comprising electrodepositing said copper powder from an electrolyte solution comprising copper ions, sulfate ions free chloride ions and iron ions, the concentration of said copper ions being in the range of about 2 to about 7 grams per liter, the free chloride ion concentration being in the range of about 8 to about 20 ppm, said electrolyte solution having an impurity level of no more than about 0.4 gram per liter and being free of organic additives.

2. The process of claim 1 wherein the temperatures of said electrolyte solution is in the range of about 15° C. to about 35° C.

3. The process of claim 1 wherein said electrolyte solution has a free sulfuric acid concentration in the range of about 100 to about 200 grams per liter.

4. The process of claim 1 wherein said electrodepositing is conducted in an electroforming cell equipped with an anode and a cathode immersed in said electrolyte solution, the flow rate of electrolyte solution through said electroforming cell being in the range of about 0.01 to about 0.3 gallons per minute per square foot of the immersed surface area of said cathode.

5. The process of claim 1 wherein said electrodepositing is conducted in an electroforming cell equipped with an anode and a cathode, said anode being a dimensionally stable anode, said cathode being constructed of titanium.

6. The process of claim 1 wherein said electrodepositing is conducted in an electroforming cell equipped with an anode and a cathode and an electric current is used to apply an effective amount of voltage across said anode and said cathode to deposit said copper powder on said cathode, the current density being in the range of about 80 to about 120 ASF.

7. The process of claim 1 wherein said electrodepositing is conducted in an electroforming cell equipped with an anode and a cathode, the spacing between said anode and said cathode being from about 1 to about 4 inches.

8. The process of claim 1 wherein the concentration of iron in said electrolyte solution is no more than about 0.2 gram per liter.

9. A process for making copper powder having an apparent density in the range of about 0.20 to about 0.60 gram per cubic centimeter, and a surface area of at least about 0.5 square meter per gram, said process comprising:

(A) contacting a copper-bearing material with an effective amount of at least one aqueous leaching solution to dissolve copper ions into said leaching solution and form a copper-rich aqueous leaching solution;

(B) contacting said copper-rich aqueous leaching solution with an effective amount of at least one water-insoluble extractant to transfer copper ions from said copper-rich aqueous leaching solution to said extractant to form a copper-rich extractant and a copper-depleted aqueous leaching solution;

(C) separating said copper-rich extractant from said copper-depleted aqueous leaching solution;

(D) contacting said copper-rich extractant with an effective amount of at least one aqueous stripping solution to transfer copper ions from said extractant to said stripping solution to form a copper-rich stripping solution and a copper-depleted extractant;

(E) separating said copper-rich stripping solution from said copper-depleted extractant, said copper-rich stripping solution being an electrolyte solution;

(F) flowing said electrolyte solution between an anode and a cathode, and applying an effective amount of voltage across said anode and said cathode to deposit said copper powder on said cathode, said electrolyte solution comprising copper ions, sulfate ions and free chloride ions, the concentration of said copper ions being in the range of about 2 to about 7 grams per liter, the free chloride ion concentration being in the range of about 8 to about 20 ppm, said electrolyte solution having an impurity level of no more than about 0.4 gram per liter and being free of organic additives; and (G) removing said copper powder from said cathode.

10. The process of claim 9 wherein said copper-bearing material is copper ore, copper concentrate, copper smelter products, smelter flue dust, copper cement, copper sulfate or copper-containing waste.

11. The process of claim 9 with the step of separating said copper-rich aqueous solution formed in step (A) from said copper-bearing material.

12. The process of claim 9 wherein said aqueous leaching solution comprises sulfuric acid, halide acid or ammonia.

13. The process of claim 9 wherein said extractant in step (B) is dissolved in an organic solvent selected from the group consisting of kerosene, benzene, naphthalene, fuel oil and diesel fuel.

14. The process of claim 9 wherein said extractant in step (B) comprises at least one compound represented by the formula

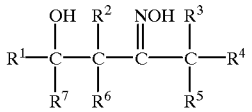

wherein $R^1$, $R^2$, $R^3$, $R^4$, $R^5$, $R^6$ and $R^7$ are independently hydrogen or hydrocarbyl groups.

15. The process of claim 9 wherein said extractant in step (B) comprises at least one compound represented by the formula

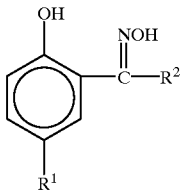

wherein $R^1$ and $R^2$ are independently hydrogen or hydrocarbyl groups.

16. The process of claim 9 wherein said extractant in step (B) comprises at least one compound represented by the formula

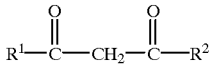

wherein $R^1$ and $R^2$ are independently alkyl groups or amyl groups.

17. The process of claim 9 wherein said extractant in step (B) comprises at least one ion exchange resin.

18. The process of claim 9 wherein said stripping solution comprises sulfuric acid.

19. A process for making copper powder having an apparent density in the range of about 0.20 to about 0.60 gram per cubic centimeter and a surface area of at least about 0.5 square meter per gram, said process comprising electrodepositing said copper powder from an electrolyte solution comprising copper ions, sulfate ions free chloride ions and iron ions, the concentration of said copper ions being in the range of about 2 to about 7 grams per liter, the free chloride ion concentration being in the range of about 8 to about 20 ppm, said electrolyte solution having an impurity level of no more than about 1.0 gram per liter and being free of organic additives, wherein the concentration of iron in said electrolyte solution is no more than about 0.2 gram per liter.

* * * * *